US010774727B2

(12) United States Patent
Schneider

(10) Patent No.: US 10,774,727 B2
(45) Date of Patent: Sep. 15, 2020

(54) DEVICE FOR CONDUCTING AIR WITH COOLING CHAMBER VENTING FOR AN INTERNAL COMBUSTION ENGINE

(71) Applicant: MAN Truck & Bus AG, Munich (DE)

(72) Inventor: Thomas Schneider, Burgthann (DE)

(73) Assignee: MAN TRUCK & BUS AG, Munich (DE)

( * ) Notice: Subject to any disclaimer, the term of this patent is extended or adjusted under 35 U.S.C. 154(b) by 130 days.

(21) Appl. No.: 16/005,186

(22) Filed: Jun. 11, 2018

(65) Prior Publication Data

US 2018/0355785 A1 Dec. 13, 2018

(30) Foreign Application Priority Data

Jun. 12, 2017 (DE) ..... 10 2017 112 858

(51) Int. Cl.

| | |
|---|---|
| ***F01P 11/02*** | (2006.01) |
| ***F02F 1/36*** | (2006.01) |
| ***F01P 3/02*** | (2006.01) |
| ***F02M 35/10*** | (2006.01) |
| ***F02M 35/104*** | (2006.01) |

(52) U.S. Cl.

CPC ..... *F01P 11/0285* (2013.01); *F01P 3/02* (2013.01); *F01P 11/02* (2013.01); *F01P 11/028* (2013.01); *F02F 1/36* (2013.01); *F02M 35/104* (2013.01); *F02M 35/10209* (2013.01); *F02M 35/10354* (2013.01); *F01P 2003/024* (2013.01); *F02M 35/10242* (2013.01)

(58) Field of Classification Search

CPC ..... F01P 11/0285; F01P 3/02; F01P 11/02; F01P 11/028; F01P 2003/024; F02F 1/36; F02M 35/10209; F02M 35/10354; F02M 35/104; F02M 35/10242

USPC ..... 123/41.54

See application file for complete search history.

(56) References Cited

U.S. PATENT DOCUMENTS 4,553,505 A * 11/1985 Hirano ..... F01P 3/2285 123/41.2
4,622,931 A * 11/1986 Wickramasuriya ..... F02D 9/16 123/190.2

(Continued)

FOREIGN PATENT DOCUMENTS

DE 19920195 A1 11/2000
DE 102010023812 A1 12/2011

(Continued)

*Primary Examiner* — Joseph J Dallo
*Assistant Examiner* — Yi-Kai Wang
(74) *Attorney, Agent, or Firm* — Weber Rosselli & Cannon LLP

(57) ABSTRACT

The present disclosure relates to a device for conducting air, in particular inlet air distributor pipe, for an internal combustion engine with a plurality of cylinder heads. The device for conducting air includes a pipe body. The pipe body has an air distribution channel with a plurality of outlet openings for connecting to a plurality of inlet channels of the plurality of cylinder heads. The pipe body includes a plurality of single venting channels for connecting to a plurality of coolant chambers of the plurality of cylinder heads for venting the plurality of coolant chambers. The pipe body additionally includes a collective venting channel, the plurality of single venting channels discharging therein.

21 Claims, 2 Drawing Sheets

(56) References Cited

U.S. PATENT DOCUMENTS

| | | | | |
|---|---|---|---|---|
| 5,031,579 | A * | 7/1991 | Evans | F01P 3/2207 123/41.2 |
| 6,230,669 | B1 * | 5/2001 | Evans | F01P 3/22 123/41.42 |
| 6,810,838 | B1 | 11/2004 | Hellman | |
| 6,840,221 | B1 | 1/2005 | Rowells et al. | |
| 2006/0249104 | A1 * | 11/2006 | Stemmer | F02F 1/108 123/41.44 |
| 2013/0000579 | A1 * | 1/2013 | Schuseil | F01L 1/02 123/90.17 |

FOREIGN PATENT DOCUMENTS

| | | | |
|---|---|---|---|
| EP | 1514020 | B1 | 12/2005 |
| EP | 2161438 | A2 | 3/2010 |
| JP | S55108215 | U | 7/1980 |
| JP | H08200063 | A | 8/1996 |
| JP | 2010048114 | A | 3/2010 |

* cited by examiner

DEVICE FOR CONDUCTING AIR WITH COOLING CHAMBER VENTING FOR AN INTERNAL COMBUSTION ENGINE

BACKGROUND

The present disclosure relates to a device for conducting air, in particular an inlet air distributor pipe, for an internal combustion engine.

For cooling cylinder heads a coolant may be passed through the cylinder head. The coolant flows in a so-called coolant chamber or coolant core which, when water is used as the coolant, is also denoted as the water core. When using single cylinder-cylinder heads (single cylinder heads) each cylinder head comprises a separate coolant chamber.

In the coolant chamber of a cylinder head, at the points with a low flow velocity and a high local temperature, the coolant may boil locally in the coolant chamber. Bubbles of steam are formed at the same time. This steam has to be discharged from the coolant chamber, i.e. the coolant chamber has to be vented.

EP 1 514 020 A1 discloses a cylinder head of a reciprocating internal combustion engine with a cylinder head lower part, a cylinder head cover and a frame for mounting a shaft and axle of a gas exchange controller. The frame is mounted on the cylinder head lower part and the cylinder head cover is placed on the frame. The frame has a device for venting the cooling system of the internal combustion engine. In detail, a channel for venting the cooling system runs in the outer wall on the longitudinal side over the entire length of the frame, on each cylinder said channel having a flow connection to the highest geodesic point of the water chamber of the cylinder head and thus of the entire cylinder.

It is known to discharge the steam via venting channels which are connected to the coolant chamber. For example, when using single cylinder-cylinder heads, separate soldered pipelines are connected to the coolant chambers as venting lines. The pipelines lead to a container to which the discharged steam is conducted.

The assembly of the soldered pipelines may be costly. The assembly may require additional seals, connecting means, etc. Thus improvements to such systems are desired.

SUMMARY

The object of the present disclosure is to provide improved venting for the coolant chambers, in particular in the case of a plurality of single cylinder-cylinder heads. The improved venting is intended to be easier to assemble and/or require fewer components.

The objects are achieved by a device for conducting air, in particular an inlet air distributor pipe, for an internal combustion engine according to the present disclosure.

The device for conducting air for the internal combustion engine with a plurality of cylinder heads comprises a pipe body. The pipe body comprises an air distribution channel with a plurality of outlet openings for connecting to a plurality of inlet channels of the plurality of cylinder heads. The pipe body comprises a plurality of single venting channels for connecting to a plurality of coolant chambers of the plurality of cylinder heads for venting the plurality of coolant chambers. The pipe body comprises a collective venting channel, the plurality of single venting channels discharging therein.

The air distribution channel, the single venting channels and the collective venting channel are therefore all integrated in the pipe body. Thus it is no longer necessary to connect separate soldered pipelines to the individual cylinder heads for venting the respective coolant chambers. The inlet air distributor pipe is particularly suitable for receiving the venting channels since it is arranged in any case in the region of the cylinder heads for introducing the inlet air.

The air distribution channel serves for distributing the inlet air to the cylinder of the internal combustion engine.

The air distribution channel and/or the pipe body may be arranged downstream of an air inlet manifold (intake manifold) and/or upstream of inlet channels of the cylinder heads.

The air distribution channel may, in particular, be provided separately (separated and fluidically isolated) from the single venting channels and/or separately (separated and fluidically isolated) from the collective venting channel.

Opposing ends of the collective venting channel may be sealed in each case by a cover.

One end of the single venting channel may be sealed by a cover. The other end of the single venting channel may produce a connection with the coolant chamber.

In one embodiment, the collective venting channel extends in a longitudinal direction of the pipe body and/or parallel to the air distribution channel. This has the advantage that single venting channels may discharge into the collective venting channel along the (entire) length of the pipe body.

In a further embodiment, the collective venting channel is bored. The collective venting channel, in particular, is bored by a deep boring method. Alternatively, the collective venting channel is cast. The production of a bore is able to be implemented in a simple manner in terms of production technology. The use of a deep boring method permits a particularly long collective venting channel which, for example, may extend along the entire length of the pipe body. If the collective venting channel is cast, however, the production of the collective venting channel may be undertaken directly when casting the pipe body.

In an exemplary embodiment, the plurality of single venting channels is bored. Alternatively, the plurality of single venting channels is cast. The boring of single venting channels is able to be implemented in a simple manner in terms of production technology. On the other hand, the single venting channels may also be configured directly when casting the pipe body.

In a further exemplary embodiment, the collective venting channel and/or the plurality of single venting channels in each case are bored on two sides. In other words, the respective channel is bored from both ends of the channel.

In one variant, the plurality of single venting channels is provided selectively for each cylinder, for each cooling chamber of the plurality of coolant chambers of each cylinder head of the plurality of cylinder heads. Thus each individual cooling chamber of the plurality of cylinder heads may be vented by the single venting channels and the collective venting channel.

In a further variant, the pipe body further comprises a venting outlet channel which is connected to the collective venting channel and/or is able to be connected to a collection container. By means of the venting outlet channel, the collective venting channel may be ventilated and the steam conducted to the collection container.

The venting outlet channel may be bored or cast as a tapping of the collective venting channel. This permits the venting outlet channel to be produced in a simple manner.

Advantageously, the venting outlet channel extends in a radial direction relative to a longitudinal axis of the pipe body.

In one development, the collective venting channel and/or the plurality of single venting channels extend in a pipe wall of the pipe body. The pipe wall may surround the air distribution channel. Thus the collective venting channel and the single venting channels may be provided in a space-saving manner in the pipe body.

In an advantageous development, the plurality of single venting channels in each case extends in a peripheral direction of the pipe body in the pipe wall of the pipe body.

In a further advantageous development, the collective venting channel extends in a longitudinal direction of the pipe body in the pipe wall of the pipe body.

The combination of the directions of extension of the single venting channels and of the collective venting channel permit a simple arrangement of the channels with short paths.

In one embodiment, the plurality of single venting channels in each case comprise a first, in particular bored, portion and a second, in particular bored, portion. The first portion and the second portion meet at an angle, in particular an obtuse angle. This has the advantage that the single venting channels, in particular, may be arranged in a peripheral direction of the pipe wall of the pipe body without having to provide a complex geometry for the single venting channels.

The first portion of the single venting channel may extend, in particular, in a linear manner and/or the second portion of the single venting channel may extend, in particular, in a linear manner.

It is also conceivable that the collective venting channel extends, in particular, in a linear manner.

In a further embodiment, the first portion is arranged upstream of the second portion and the second portion discharges into the collective venting channel. The second portion may, for example, intersect with the collective venting channel.

In one exemplary embodiment, the plurality of single venting channels is arranged at a uniform distance from one another in a longitudinal direction of the pipe body. This has the advantage that cylinder heads, which are uniformly spaced apart from one another and are of identical configuration, with corresponding coolant chambers may be connected to the single venting channels.

The present disclosure further relates to an arrangement. The arrangement comprises a plurality of single cylinder-cylinder heads (single cylinder heads) for covering a plurality of cylinders of an internal combustion engine. The single cylinder-cylinder heads in each case have a coolant chamber, in particular a water core, for cooling the respective single cylinder-cylinder head. The arrangement additionally has a device for conducting air as disclosed herein. The plurality of single venting channels is connected in each case to one of the plurality of coolant chambers.

The single cylinder-cylinder heads may, in particular, be of identical construction and/or arranged uniformly spaced apart from one another.

The device for conducting air, in particular the pipe body, may be assembled on the single cylinder-cylinder heads.

The present disclosure further relates to a motor vehicle having a device for conducting air as disclosed herein or an arrangement as disclosed herein.

BRIEF DESCRIPTION OF THE DRAWINGS

The embodiments and features of the present disclosure described above are able to be combined together in any manner. Further details and advantages of the present disclosure are described hereinafter with reference to the accompanying drawings, in which.

Figure 1:
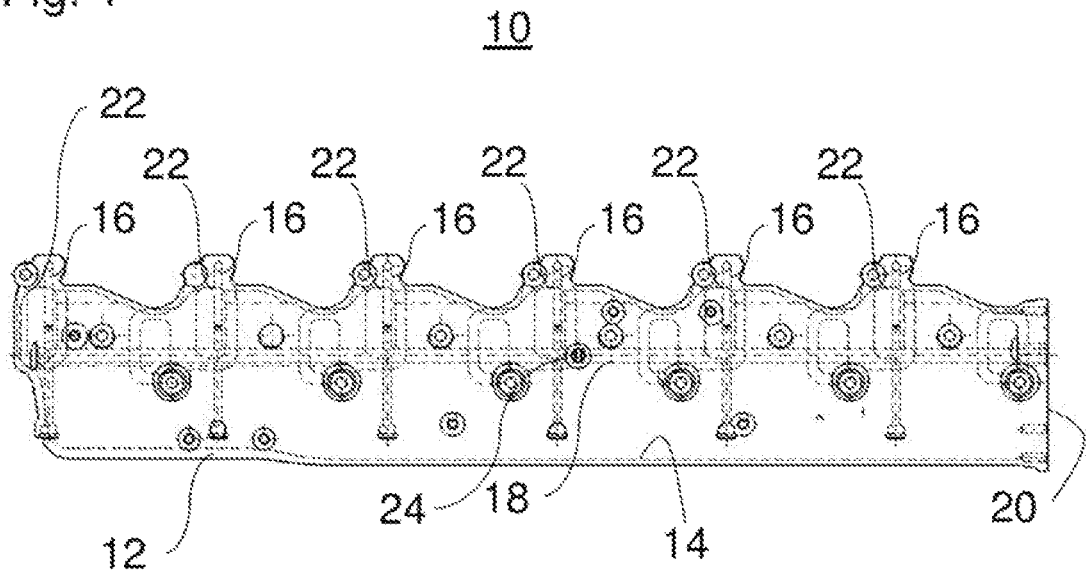
FIG. 1 shows a perspective view of an exemplary air distributor pipe.

The embodiments shown in the figures at least partially coincide with one another so that parts which are similar or identical are provided with the same reference numerals and for the explanation thereof reference is also made to the description of the other embodiments and/or figures in order to avoid repetition.

DETAILED DESCRIPTION

Figure 2:
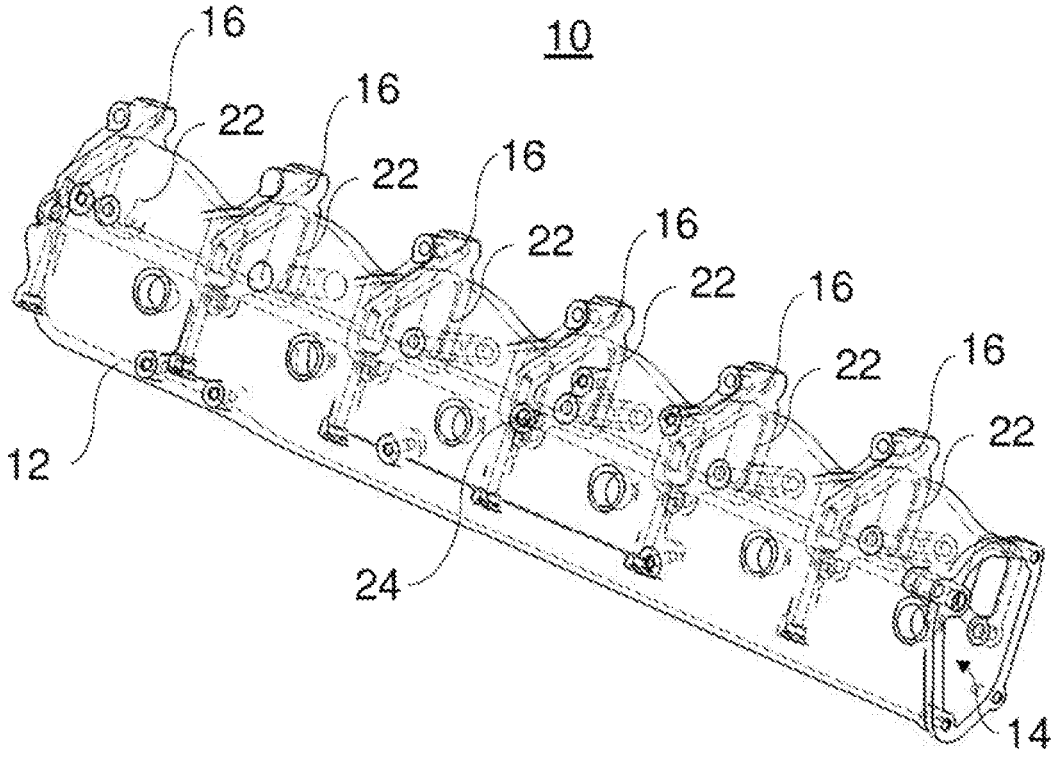
FIG. 2 shows a further perspective view of the exemplary air distributor pipe.

FIGS. 1 and 2 show different views of a device for conducting air configured as an inlet air distributor pipe 10. The inlet air distributor pipe 10 is shown such that concealed elements or elements arranged inside the inlet air distributor pipe 10 are shown in dashed lines. The inlet air distributor pipe 10 may be part of an internal combustion engine (not shown) of a motor vehicle, in particular a utility vehicle. The utility vehicle may, for example, be a bus or a truck.

The inlet air distributor pipe 10 has a pipe body 12. An air distribution channel 14, a plurality of single venting channels 16 and a collective venting channel 18 extend in the pipe body 12. The pipe body 12 may, for example, be a metal cast part, for example made of an aluminium alloy.

The inlet air distributor pipe 10 may be assembled onto a cylinder head, in particular screwed thereto. In other embodiments, the inlet air distributor pipe 10 may be cast directly onto the cylinder head. In other words, the inlet air distributor pipe 10 and the cylinder head may be configured as an integral cast part.

The air distribution channel 14 extends between an inlet opening 20 and a plurality of outlet openings 22. Each outlet opening 22 is able to be connected to an inlet channel in a cylinder head. In the assembled state, each outlet opening 22 discharges into one respective inlet channel of a plurality of single cylinder-cylinder heads (single cylinder heads).

The air distribution channel 14 extends in a longitudinal direction of the pipe body 12. The air distribution channel 14 may be formed when casting the pipe body 12.

The single venting channels 16 and the collective venting channel 18 are provided separately from the air distribution channel 14 in the pipe body 12. In the embodiment shown, six single venting channels 16 are shown for ventilating six coolant chambers of the single cylinder heads.

The single venting channels 16 are arranged at a uniform spacing in a longitudinal direction of the pipe body 12. The single venting channels 16 extend in a pipe wall (outer wall) of the air distribution channel 14. The single venting channels 16 extend in a peripheral direction about a longitudinal axis of the pipe body 12. The single venting channels 16 may be bored or cast. In particular, the single venting channels 16 may be bored on two sides (see exemplary embodiments thereof in the description of FIG. 3).

The single venting channels 16 discharge into the collective venting channel 18. The collective venting channel 18 extends in the pipe wall (outer wall) of the air distribution channel 14. The collective venting channel 18 extends in a longitudinal direction of the pipe body 12 parallel to the air distribution channel 14. The collective venting channel 18 may be bored or cast. In particular, the collective venting channel 18 may be bored on one side or preferably on two sides by a deep boring method. The two ends of the collective venting channel 18 may be provided for sealing with a cover.

The pipe body 12 has a venting outlet channel 24, the steam being able to be discharged through said venting outlet channel from the coolant chamber of the cylinder head into a collection container (not shown). The venting outlet channel 24 may be bored or cast. In particular, the venting outlet channel 24 may be bored as a tapping of the collective venting channel 18. The venting outlet channel 24 extends in a radial direction relative to a longitudinal axis of the pipe body 12.

Figure 3:
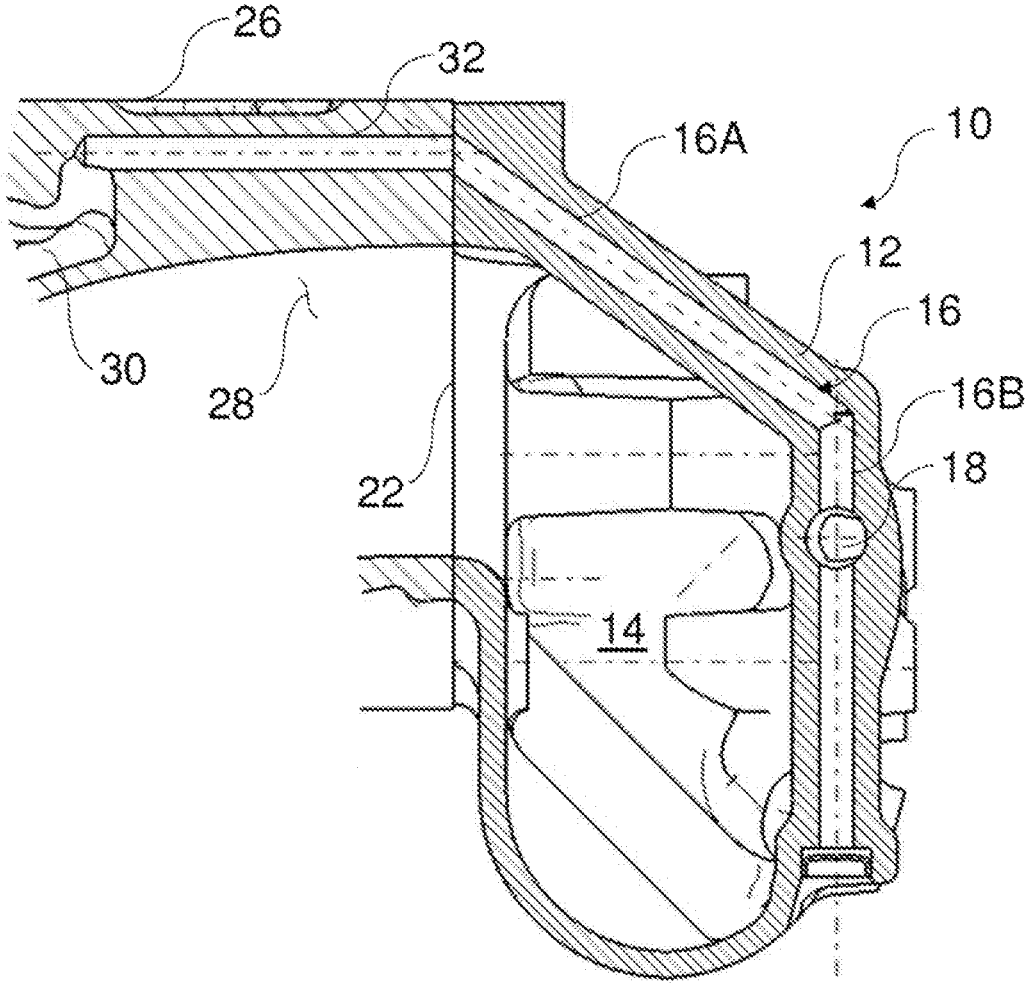
FIG. 3 shows a sectional view through the exemplary air distributor pipe and a portion of a cylinder head.

FIG. 3 shows the inlet air distributor pipe 10 in an assembled state on a single cylinder head 26. The cutting plane of FIG. 3 is selected such that a single venting channel 16 extends in the cutting plane. The remaining single venting channels and single cylinder heads may be of similar or identical construction.

The cylinder head 26 has an inlet channel 28 and a coolant chamber (cooling jacket) 30. In FIG. 3 the cylinder head 26, the inlet channel 28 and the coolant chamber 30 are only partially shown. The inlet channel 28 leads to a combustion chamber of a cylinder of the internal combustion engine. The air distribution channel 14 leads into the inlet channel 28.

During operation of the internal combustion engine, the cylinder head 26 is heated up. For cooling the cylinder head 26 and the components arranged therein a coolant, for example water, circulates in the coolant chamber 30.

In the coolant chamber 30, during operation of the engine, bubbles of steam are formed in the coolant due to local boiling of the coolant. These bubbles of steam are transported away as follows. A venting channel 32 connects an upper portion of the coolant chamber 30 to the single venting channel 16. The venting channel 32 may, in particular, be bored by tapping the coolant chamber 30. The resulting steam is transported from the coolant chamber 30 through the venting channel 32 of the cylinder head 26 and the single venting channel 16 of the inlet air distributor pipe 10 to the collective venting channel 18. The steam is diverted from the collective venting channel 18 via the venting outlet channel 24 (see FIGS. 1 and 2).

The single venting channel 16 has a first portion 16A and a second portion 16B. The first portion 16A extends between the venting channel 32 of the cylinder head 26 and the second portion 16B. The second portion 16B extends between the first portion 16A via the collective venting channel 18 to an opening 16C. The opening 16C may be sealed by a cover. The first portion 16A is, in particular, bored starting from an end opposing the second portion 16B.

The second portion 16B is, in particular, bored starting from the opening 16C. The first portion 16A and the second portion 16B extend through the pipe body 12, meet at an obtuse angle to one another and together form the single venting channel 16.

Although in FIG. 3 only one individual single venting channel 16 is shown, the remaining single venting channels 16 (see FIGS. 1 and 2) may be configured in the manner of the single venting channel disclosed with reference to FIG. 3.

The first portion 16A extends above an outlet region of the air distribution channel 14. The venting channel 32 extends above the inlet channel 28.

By the integration of the single venting channels 16 and the collective venting channel 18 in the pipe body 12 of the inlet air venting pipe 10, it is no longer necessary to attach separate venting lines to the individual cylinder heads 26 for venting the coolant chambers. In other words, the inlet air distributor pipe 10 integrates the function of air distribution to the individual cylinders (cylinder heads) and the function of venting the coolant chambers to the individual cylinder heads.

The present disclosure is not limited to the exemplary embodiments disclosed above. Instead a plurality of variants and modifications which also make use of the concepts and ideas of the present disclosure and, therefore, fall within the protected scope of the present disclosure are possible.

LIST OF REFERENCE NUMERALS

10 Inlet air distributor pipe (device for conducting air)
12 Pipe body
14 Air distribution channel
16 Single venting channel
16A First portion of single venting channel
16B Second portion of single venting channel
16C Opening of single venting channel
18 Collective venting channel
20 Inlet opening
22 Outlet opening
24 Venting outlet channel
26 Cylinder head
28 (Air) inlet channel of cylinder head
30 Coolant chamber (cooling jacket)
32 Venting channel of cylinder head

The invention claimed is:

1. A device for conducting air for an internal combustion engine with a plurality of cylinder heads, comprising:
- a pipe body having:
- an air distribution channel with a plurality of outlet openings for connecting to a plurality of inlet channels of the plurality of cylinder heads;
- a plurality of single venting channels for connecting to a plurality of coolant chambers of the plurality of cylinder heads for venting the plurality of coolant chambers; and
- a collective venting channel, the plurality of single venting channels discharging therein.

2. The device for conducting air according to claim 1, wherein the device for conducting air is an inlet air distributor pipe.

3. The device for conducting air according to claim 1, wherein the collective venting channel extends in a longitudinal direction of the pipe body or parallel to the air distribution channel.

4. The device for conducting air according to claim 1, wherein:
- the collective venting channel is bored by a deep boring method; or the collective venting channel is cast.

5. The device for conducting air according to claim 1, wherein:
- the plurality of single venting channels is bored; or the plurality of single venting channels is cast.

6. The device for conducting air according to claim 1, wherein the collective venting channel or the plurality of single venting channels in each case are bored on two sides.

7. The device for conducting air according to claim 1, wherein the plurality of single venting channels is provided selectively for each cylinder, for each coolant chamber of the plurality of coolant chambers of each cylinder head of the plurality of cylinder heads.

8. The device for conducting air according claim 1, wherein the pipe body comprises a venting outlet channel which is connected to the collective venting channel and is able to be connected to a collection container.

9. The device for conducting air according to claim 8, wherein:

the venting outlet channel is bored or cast as a tapping of the collective venting channel; or the venting outlet channel extends in a radial direction relative to a longitudinal axis of the pipe body.

10. The device for conducting air according to claim 1, wherein the collective venting channel or the plurality of single venting channels extend in a pipe wall of the pipe body.

11. The device for conducting air according to claim 10, wherein:

the plurality of single venting channels in each case extends in a peripheral direction of the pipe body in the pipe wall of the pipe body; or the collective venting channel extends in a longitudinal direction of the pipe body in the pipe wall of the pipe body.

12. The device for conducting air according to claim 1, wherein the plurality of single venting channels in each case comprise a first bored portion and a second bored portion which meet at an angle.

13. The device for conducting air according to claim 12, wherein the angle is an obtuse angle.

14. The device for conducting air according to claim 13, wherein the first portion is arranged upstream of the second portion and the second portion discharges into the collective venting channel.

15. The device for conducting air according to claim 1, wherein the plurality of single venting channels is arranged at a uniform distance from one another in a longitudinal direction of the pipe body.

16. An arrangement for an internal combustion engine comprising:

a plurality of single cylinder-cylinder heads for covering a plurality of cylinders of an internal combustion engine, wherein the single cylinder-cylinder heads in each case have a coolant chamber for cooling the respective single cylinder-cylinder head; and a device for conducting air including a pipe body having an air distribution channel with a plurality of outlet openings for connecting to a plurality of inlet channels of the plurality of cylinder heads, a plurality of single venting channels connected in each case to one of the plurality of coolant chambers for venting the plurality of coolant chambers, and a collective venting channel, the plurality of single venting channels discharging therein.

17. The arrangement according to claim 16, wherein the coolant chamber is a water core.

18. The arrangement of claim 16, further comprising a motor vehicle in which the internal combustion engine is installed.

19. The arrangement of claim 18, wherein the motor vehicle is a utility vehicle.

20. The device for conducting air according to claim 1, further comprising a motor vehicle in which the internal combustion engine is installed.

21. The device for conducting air according to claim 20, wherein the motor vehicle is a utility vehicle.

* * * * *